United States Patent [19]

Colodner et al.

[11] Patent Number: 4,812,124

[45] Date of Patent: Mar. 14, 1989

[54] HEXADECIMAL ABACUS

[75] Inventors: Jesse L. Colodner, Pearl River, N.Y.; Lawrence A. Clopper, III, 39-70 46th St., Sunnyside, N.Y. 11104

[73] Assignee: Lawrence A. Clopper, Sunnyside, N.Y.

[21] Appl. No.: 157,580

[22] Filed: Feb. 19, 1988

[51] Int. Cl.[4] ..... G06C 1/00

[52] U.S. Cl. ..... 434/203

[58] Field of Search ..... 434/203, 204

[56] References Cited

U.S. PATENT DOCUMENTS

| | | | |
|---|---|---|---|
| 465,811 | 12/1891 | Anderson | 434/203 |
| 3,076,272 | 2/1963 | Schott | 434/203 |
| 3,092,917 | 6/1963 | Podell | 434/203 |
| 3,500,558 | 3/1970 | Mateuczyk | 434/203 X |
| 3,633,287 | 1/1972 | Squires et al. | 434/203 |
| 3,688,418 | 9/1972 | Wilson | 434/203 |
| 4,448,579 | 5/1984 | Currie | 434/203 |

*Primary Examiner*—William H. Grieb

[57] ABSTRACT

This abacus is an accurate instrument that is capable of performing complex arithmetic functions in the hexadecimal number system. Primarily, it consists of a frame having a multiple number of rods extending through a cross bar member, and eight beads are provided below the cross bar and three beads are provided above the cross bar. The value of the beads above the bar is eight and the value of the beads below the bar is one.

1 Claim, 1 Drawing Sheet

HEXADECIMAL ABACUS

BACKGROUND AND FIELD OF THE INVENTION

This invention relates to calculators, and more particularly, to a hexadecimal abacus.

DESCRIPTION OF PRIOR ART

References are the U.S. Pat. Nos. Currie 4,448,579, Wilson 3,688,418, Squires et al 3,633,287, Matejczyk 3,500,558, and Schott 3,076,272. While these devices may be suitable for the particular purpose to which they address, they would not be as suitable for the purpose of the present invention, as hereinafter will be described.

The principal object of this invention is to provide a hexadecimal abacus that will be of such design, as to be a unique blend of the prior art with the hexadecimal number system, upon which modern computer systems are based.

The abacus originated in the Orient and has been indispensable to commerce in the areas where widely employed. Even today it is used in many small businesses in China and other Oriental countries, and is even widely used in places, such as Chinatowns in large cities around the world.

Abacuses of the prior art designed for commercial use, as opposed to those used for educational purposes, have seen little evolution, and have been built to perform calculations in the commonly used base 10 number system only. Although the present invention would have little practical use in industry, it will perform some of the same calculations as a hexadecimal calculator, and with equal accuracy. Evidence has shown that something of this nature would have a wide appeal among people who are familiar with the workings of computers, and thus it is believed that the present invention will be highly marketable.

There is virtually nothing either in retail computer stores or in mail order sections of computer magazines, that can be bought for under ten or twenty dollars. The present invention could sell by the tens of thousands to impulse buyers and gift shoppers alone.

Each day, thousands of people perform hexadecimal calculations with calculators. Since this abacus actually works, there would be a curiosity inspired interest in performing computer oriented calculations with an ancient accounting device, such as the abacus.

Computer professionals are necessarily intelligent, are growing in number, as is their disposable income, and are often curious about new technical gadgetry that they are lucky enough to get their hands on, especially if it has to do with computers.

Because of the newness of the computer industry, advertising strategies often attempt to identify their product with something that causes the "it" to be perceived as historical or cultural, to give it an air of permanence, and what could be more deeply rooted than an abacus?

A further object of this invention is to provide a hexadecimal abacus that will be a very accurate mathematical instrument capable of performing complex arithmetic operations in the hexadecimal numerical system.

SUMMARY OF THE INVENTION

A hexadecimal abacus comprises a frame with a cross bar secured therein, and eight rods are secured in the frame, the lower portions of the rods containing eight beads and the upper section contains three beads, the total being eleven beads in each column, and functionally, this abacus is primarily the same as that of a base ten or decimal abacus, with the exception of the number of beads and the value of each bead.

DETAILED DESCRIPTION

Figure 1:
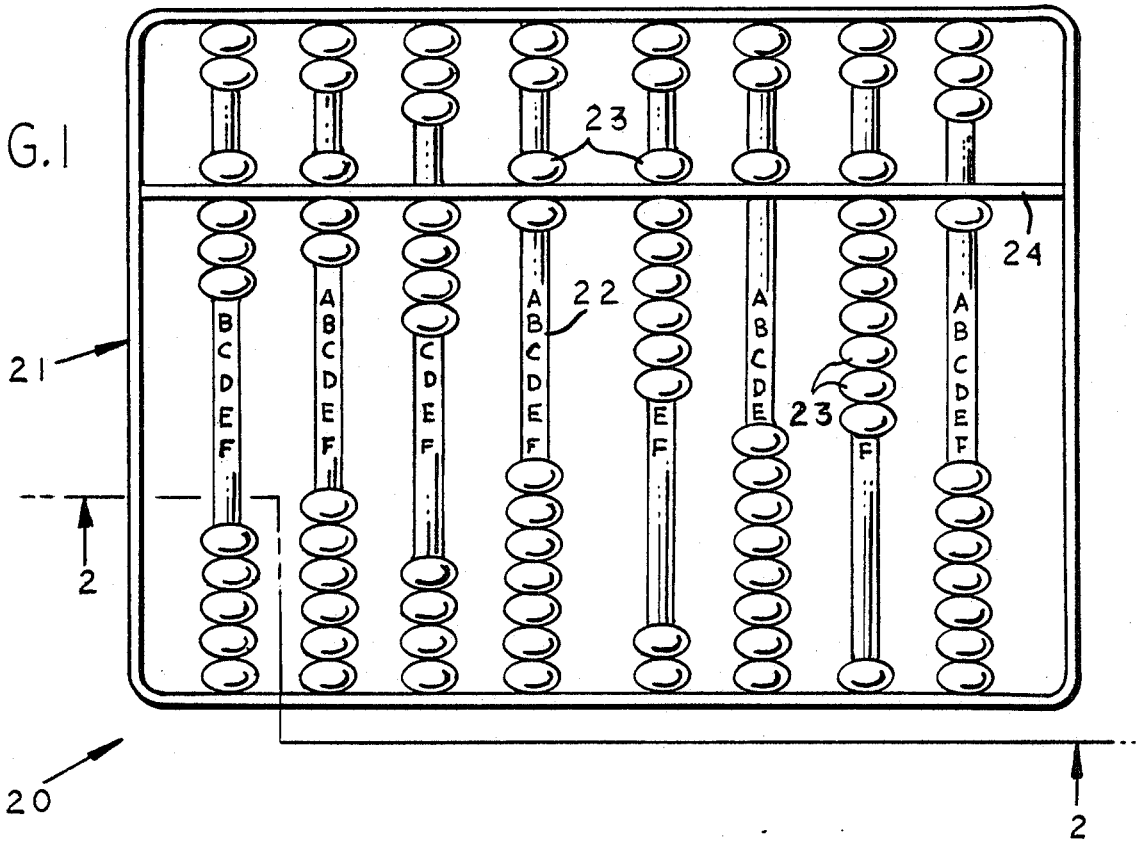
FIG. 1 is a front elevational view of the instant invention.
Figure 2:
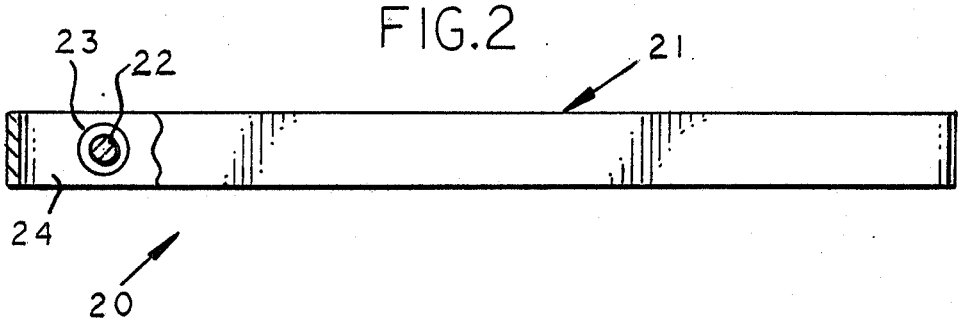
FIG. 2 is a cross-sectional view taken along the line 2—2 of FIG. 1.

Accordingly, an abacus instrument 20 is shown to include a rectangular configurated frame 21 provided with a plurality of equally-spaced rods 22, upon which are slideably received a plurality of beads 23 for performing calculations. Rods 22 extend through a cross bar 24 that is fixedly secured to the inside surfaces of frame 21, and the ends of rods 22 are fixedly secured to the longitudinal inside surfaces of frame 20. The total number of beads 23 on the rods 22 are eleven in all, and three of this number are positioned above the cross bar 24. The beads 23 above the bar 24 are worth eight each, and the beads 23 below bar 24 are worth one. Letter characters from A to F are inscribed upon the outer peripheral surfaces of rods 22, for employment in calculations.

In use for example, the calculations shown in FIG. 1 is easily read out in hexadecimal as BA49E8F1, and beads 23 are slid along rods 22 by the operator's fingers.

It shall also be recognized that rods 22 could be labeled to ease the counting of beads 23 below the bar 24, thereby lessening the time needed to read the result of a calculation, and the third top bead 23 would be employed as a learning aid by novices and by the proficient when a calculation is sufficiently complex to render "clearing" or "carrying", inconvenient until the end of the calculation.

While various changes may be made in the detailed construction, such changes will be within the spirit and scope of the present invention, as defined by the appended claims.

We claim:

1. A hexadecimal abacus comprising a substantially rectangular frame, a cross bar extending transversely within said frame, a plurality of rods extending within said frame through said cross bar from the top of said frame to the bottom of said frame in substantially perpendicular relation to said cross bar, and a plurality of beads slidably attached to said rods, said cross bar providing partition means for said plurality of beads, a first plurality of beads being slideably attached to said rods above said cross bar and a second plurality of beads being slideably attached to said rods below said cross bar, said first plurality of beads comprising three beads valued at eight points each, said second plurality of beads comprising eight beads valued at one point each, including letter character means inscribed in vertical alignment on the outer surface of said rods, said letter character means comprising the letters A, B, C, D, E and F.

* * * * *